US006707019B2

(12) United States Patent
Kim

(10) Patent No.: US 6,707,019 B2
(45) Date of Patent: Mar. 16, 2004

(54) VENTILATION STRUCTURE OF MICROWAVE OVEN AND LAMP FITTING STRUCTURE THEREFOR

(75) Inventor: Gi Young Kim, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/006,138

(22) Filed: Dec. 10, 2001

(65) Prior Publication Data

US 2002/0084269 A1 Jul. 4, 2002

(30) Foreign Application Priority Data

Dec. 30, 2000 (KR) ..... 2000-37320 U
Dec. 30, 2000 (KR) ..... 2000-37324 U

(51) Int. Cl.[7] ..... H05B 6/80
(52) U.S. Cl. ..... 219/757; 219/758; 126/299 D; 362/92
(58) Field of Search ..... 219/757, 681, 219/758; 126/21 A, 299 D; 362/92

(56) References Cited

U.S. PATENT DOCUMENTS 3,681,557 A * 8/1972 Suzuki et al. ..... 219/757
4,254,450 A * 3/1981 White et al. ..... 219/757
4,314,126 A * 2/1982 Yoshimura et al. ..... 219/757
4,403,128 A * 9/1983 Takagi et al. ..... 219/757
5,445,009 A * 8/1995 Yang et al. ..... 219/707
5,500,508 A * 3/1996 Gerl ..... 219/757
6,201,225 B1 * 3/2001 Lee ..... 219/758
6,218,654 B1 * 4/2001 Braunisch ..... 219/757

FOREIGN PATENT DOCUMENTS

JP 54-21639 * 2/1979 ..... 219/758
JP 58-203322 * 11/1983
JP 63-189714 * 8/1988 ..... 219/758
JP 6-101848 * 4/1994 ..... 219/757

* cited by examiner

*Primary Examiner*—Philip H. Leung
(74) *Attorney, Agent, or Firm*—Fleshner & Kim, LLP

(57) ABSTRACT

A microwave oven is provided which can prolong a lifetime of the oven's lamp by elimination of heat resistant tape fitted to the lighting window, and by optimizing cooling of the lamp. A ventilation structure of the microwave oven includes an air inlet, which also functions as a lighting window, located in one side of the upper surface of the cooking cavity, with the lamp mounted proximate thereto. The ventilation structure includes a ventilation motor and an air duct where the air duct guides cooling air past the lamp and into the cooking space through the air inlet.

12 Claims, 6 Drawing Sheets

VENTILATION STRUCTURE OF MICROWAVE OVEN AND LAMP FITTING STRUCTURE THEREFOR

BACKGROUND OF THE INVENTION

1. Field of the Invention

The present invention relates to a microwave oven, and more particularly, to a ventilation structure of a microwave oven, which can reduce required number of components, and improve a cooling efficiency, and a lamp fitting structure therefor.

2. Background of the Related Art

The microwave oven is a cooking appliance in which a magnetron is used for generating a microwave, and directing the microwave to a cooking object, to cause molecular movements in the cooking object, for heating the cooking object. The microwave oven of the present invention has a function for absorbing a heat from electric fittings in an electric fitting room, a function for discharging water vapor and the like in a cavity, and a hood function for absorbing and discharging water vapor and the like from a cooker (for an example, a gas oven range) installed below the microwave oven. A related art ventilation structure of a microwave oven, and a lamp fitting structure therefor will be explained with reference to the attached drawings.

Referring to FIGS. 1 and 2, the related art microwave oven is divided into a cavity 1 for heating food, and an electric fitting room 3 for fitting electric components therein. For letting air introduced into the electric fitting room 3 flow into the cavity 1, there is a perforated air inlet at a side of the cavity 1. There is a perforated air outlet 1*b* in a left part of an upper surface of the cavity 1, for discharging the air in the cavity 1.

Referring to FIG. 2, the electric fitting room 3 has electric components, starting from a magnetron 5, a high voltage transformer 6, fitted therein, and an air guide 7 connected between the air inlet 1*a* and the magnetron 5 for guiding introduction of the air cooled the magnetron into the cavity 1.

Referring to FIG. 1, there is an air duct 10 on the cavity 1 for guiding air during drawing and discharging of the air. There is a cooling fan 15 in the air duct 10 over the electric fitting room 3. There is a lamping fitting part 10*a* on one side of the air duct 10. There is a lamp bracket 20 under the lamp fitting part 10*a* having a fitting hole 20 at a side thereof for fitting the lamp 21. There is a perforated lighting window 1*c* in an upper surface of the cavity 1 opposite to the lamp 21. The lighting window 1*c* is formed in one side part of the upper surface of the cavity in the vicinity of the air inlet 1*a*, for introducing a lamp light into the cavity 1 through the lighting window 1*c*. There is heat resistant tap 25 fitted to a part over the lighting window 1*c*, for blocking the air introduced into the cavity 1 through the air inlet 1*a* to make a smoother air flow toward the air outlet 1*b*, and protecting a lamp 1 by preventing oil mist or vapor generated during cooking from coming into contact with the lamp 21.

In the meantime, there is a ventilation motor assembly 29 at a central part of the upper surface of the cavity 1 for drawing water vapor and smoke rising from a cooker below the microwave oven, heat generated in the electric fitting room, and the like through fans and inlet openings fitted on both sides thereof, and discharging to an outside of the microwave oven.

Works of the related art ventilation structure of a microwave oven will be explained with reference to the attached drawings.

The air introduced into an upper part of the electric fitting room through a vent grill (not shown) in a front surface of the microwave oven cools down the electric fittings in the electric fitting room 3, such as the magnetron, and the high voltage transformer 6, as the cooling fan rotates 15. The air heated as the magnetron 5 is cooled down is introduced into the cavity 1 through the air inlet 1*a* formed at a side of the cavity 1 by the air guide 7. Then, the air introduced into the cavity 1 escapes to an outside of the cavity 1 through the air outlet 1*b* in a left part of the upper surface thereof together with smoke, water vapor, and the like, flows guided by the air duct 10 on the upper part of the cavity 1, and discharged through a vent grill (not shown) in the front surface of the microwave oven.

In the meantime, during cooking in the microwave oven, the light of the lamp 21 passes through the lighting window 1*c* in one side part of the upper surface of the cavity 1, and lights an inside of the cavity 1. The heat resistant tape 25 attached on the lighting window 1*c* blocks the air introduced into the cavity 1 through the air inlet 1*a* from rising to a part over the cavity 1 through the lighting window 1*c* while transmitting the light. If the heat resistant tape 25 is not attached to the lighting window 1*c*, the air introduced through the air inlet 1*a* will not flow to the air outlet 1*b*, but to the lighting window 1*c* over the air inlet 1*a*. In this instance, the air flow for discharging the water vapor in the cavity formed during the cooking out of the cavity 1 is not smooth, to form dew on the door due to a temperature difference between inside and outside of the cavity 1. Moreover, if the heat resistant tape 25 is not attached to the lighting window 1*c*, electronic components, starting from the lamp 21, are liable to cause short circuit or malfunction, due to moist contained in the air rising through the lighting window 1*c*. Thus, the attachment of the heat resistant tape 25 to the lighting window 1*c* is essential in the ventilation system of the related art microwave oven.

However, the related art microwave oven causes the following problem due to a structural limitation of the ventilation system.

The heat resistant tape 25 attached to the lighting window 1*c* for making a smooth air flow to remove the water vapor from the cavity 1 is expensive as the heat resistant tape 25 is required to have both a good heat resistance and a light transmittivity, to push up a production cost.

In the ventilation structure of the related art microwave oven, since the lamp fitting space is closed in upper part and lower part as an upper surface of the lighting window 1*c* located below the lamp 21 is blocked by the heat resistant tape 25, and the lamp 21 is fitted to the lamp bracket 20 fitted to a bottom surface of the air duct 10. Therefore, overheat of the lamp 21 caused by failure of rejection of the heat from the lamp shortens a lifetime of the lamp 21.

The comparatively long air duct 10 on the cavity 1 from above the electric fitting room 3 to an upper part of left side of the cavity 1 having the air outlet 1*b* formed therein requires much material, to push up a production cost, and to make the product heavier.

SUMMARY OF THE INVENTION

Accordingly, the present invention is directed to a ventilation structure of a microwave oven that substantially obviates one or more of the problems due to limitations and disadvantages of the related art.

An object of the present invention is to provide a ventilation structure of a microwave oven, which can reduce a weight of a product, and a production cost, and prolong a lifetime of the lamp.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the ventilation structure of a microwave oven includes a cavity forming a cooking space therein having an air inlet and lighting window in one side of upper surface thereof for introducing a portion of air introduced into an electric fitting room, and an air outlet in the other side of the upper surface thereof for discharging the air in the cavity to outside of the cavity, a mounting floor at a height the same with the cavity in an upper part of the electric fitting room, for fitting electric components thereon, a ventilation motor assembly fitted to one side of a part over the cavity for drawing water vapor and the like in the cavity through the air outlet and discharging to outside of the cavity, and absorbing a heat generated at the electric fittings in the electric fitting room and discharging the heat, and an air duct fitted to the part over the cavity for separating a passage of air discharged to outside of the cavity through the air outlet and drawn into the ventilation motor assembly, and a passage of air drawn into the ventilation motor assembly through the electric fitting room.

The air duct has a form of box with an opened upper surface, and an outlet in a front surface for discharging air blown by the ventilation motor assembly through a vent grill.

The ventilation structure further includes a guide wall on an upper surface of the cavity for dividing a portion of the air introduced into the electric fitting room and guiding the portion of the air toward the air inlet and lighting window.

The guide wall is formed as one unit with the air duct, or on the upper surface of the cavity as one unit.

The ventilation structure further includes a lamp fitted between the air duct and the air inlet and lighting window for illumination of an inside of the cavity, and the lamp is fitted to a lamp bracket fitted to a bottom of the air duct.

In other aspect of the present invention, there is provided a lamp fitting structure of a microwave oven including a cavity forming a cooking space therein having an air inlet and lighting window in one side of upper surface thereof for introducing a portion of air introduced into an electric fitting room, and an air outlet in the other side of the upper surface thereof for discharging the air in the cavity to outside of the cavity, a mounting floor at a height the same with the cavity in an upper part of the electric fitting room, for fitting electric components thereon, a ventilation motor assembly fitted to one side of a part on the cavity for drawing water vapor and the like in the cavity and discharging to outside of the cavity, and absorbing a heat generated at the electric fittings in the electric fitting room and discharging the heat, an air duct fitted to a part over, and spaced from, the cavity for separating a passage of air discharged to outside of the cavity through the air outlet and drawn into the ventilation motor assembly, and a passage of air drawn into the ventilation motor assembly through the electric fitting room, a lamp bracket fitted between the air duct and the air inlet and lighting window for fitting the lamp, and a lamp fitted to the lamp bracket for illumination of an inside of the cavity.

The lamp bracket is fitted to a bottom of the air duct as one unit.

Therefore, different from the related art, since a back flow of the air through the air inlet and lighting window is prevented, the heat resistant tape attached to the air inlet and lighting window can be dispensed with, to reduce an assembly man-hour, and save a production cost.

Also, since the air introduced into the cavity through the air inlet and lighting window cools down the lamp, a lifetime of the lamp can be prolonged.

The shortened distance between the air inlet and lighting window over the cavity and the air outlet than that of the related art permits to form the air duct smaller, to save a material cost, and reduce weight of the product.

Since the ventilation structure of the present invention permits both the lamp light illumination of the cavity and the introduction of the air into the cavity by using the air inlet and lighting window over the cavity in common, a fabrication process can be simplified and a fabrication cost is saved.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
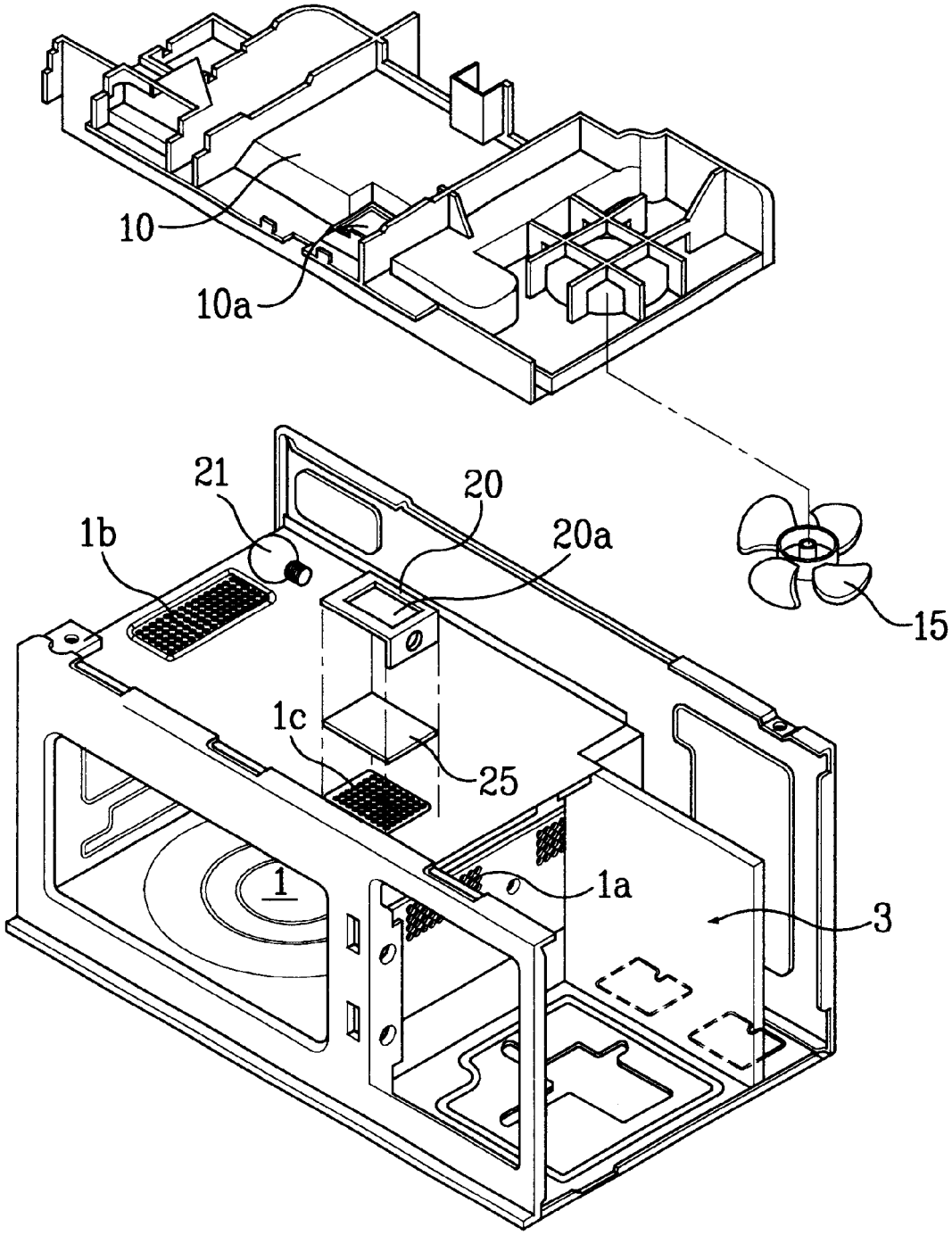
FIG.1 Related Art
FIG. 1 illustrates a perspective view of a disassembled related art microwave oven showing a ventilation structure and a lamp fitting structure therefor.
Figure 2:
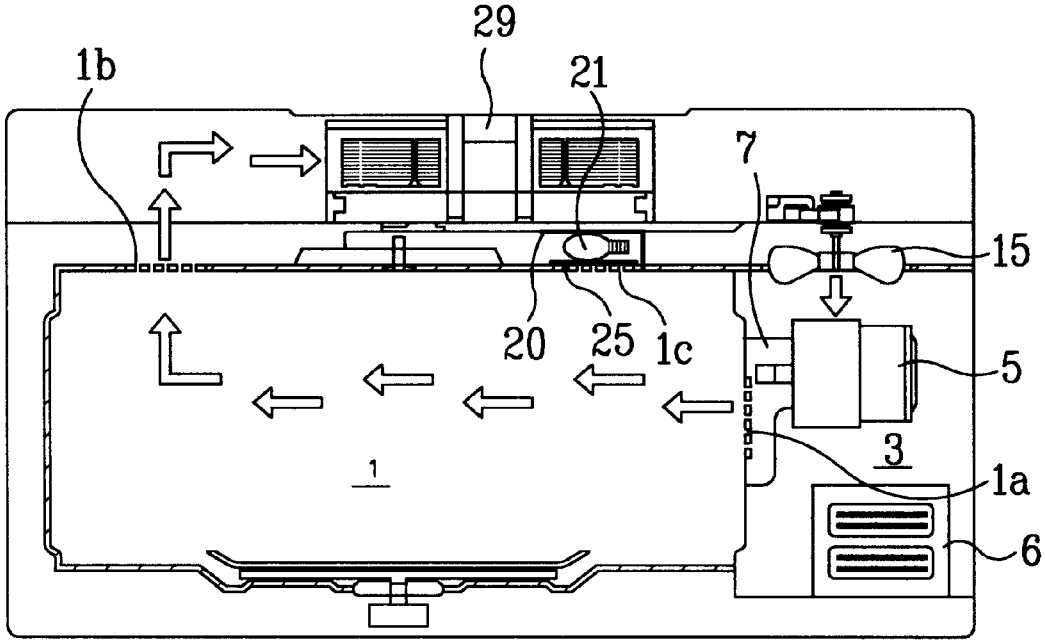
FIG.2 Related Art
FIG. 2 illustrates a section showing an air flow in the ventilation structure of the related art microwave oven.
Figure 3:
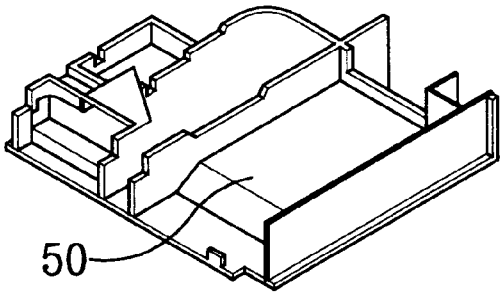
FIG. 3 illustrates a perspective view of a disassembled microwave oven showing a ventilation structure and a lamp fitting structure therefor in accordance with a first preferred embodiment of the present invention.
Figure 3:
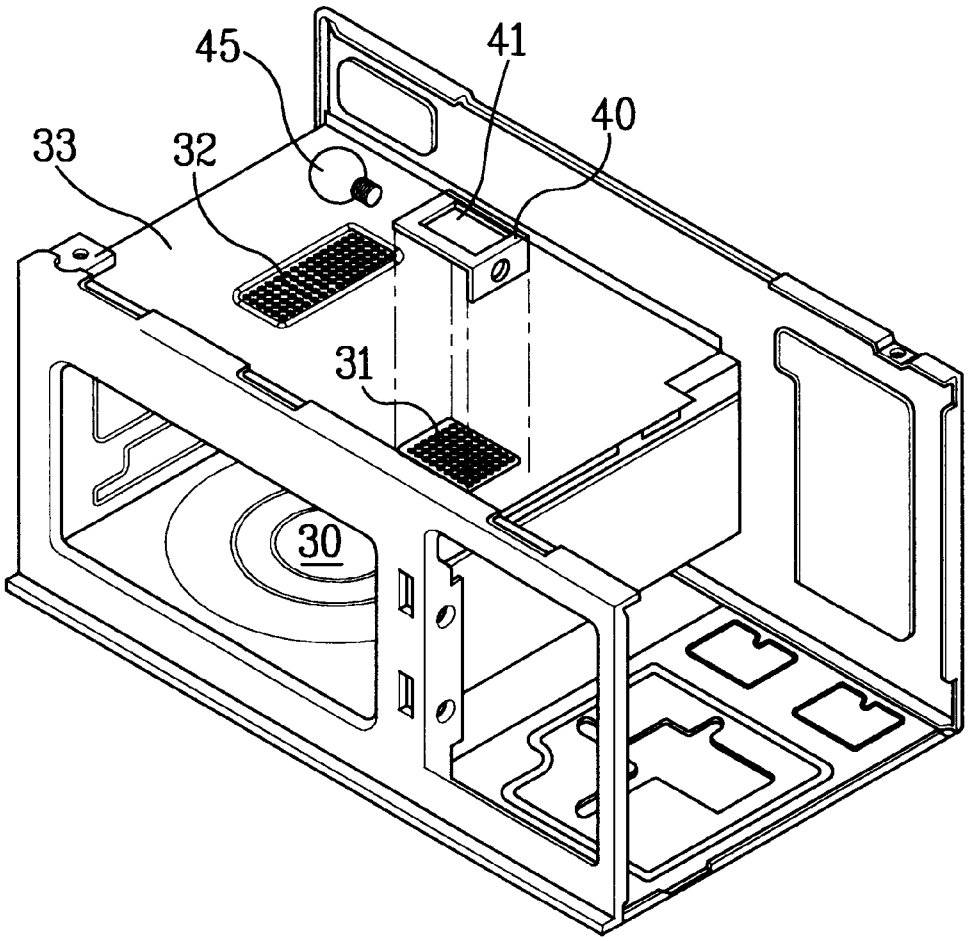

Reference will now be made in detail to the preferred embodiments of the present invention, examples of which are illustrated in the accompanying drawings. The ventilation structure and the lamp fitting structure therefor in accordance with a first preferred embodiment of the present invention will be explained, with reference to FIGS. 3 and 4. FIG. 3 illustrates a perspective view of a disassembled microwave oven showing a ventilation structure and a lamp fitting structure therefor in accordance with a first preferred embodiment of the present invention, and FIG. 4 illustrates a section showing an air flow of a ventilation system of a microwave oven in accordance with a first preferred embodiment of the present invention.

Figure 4:
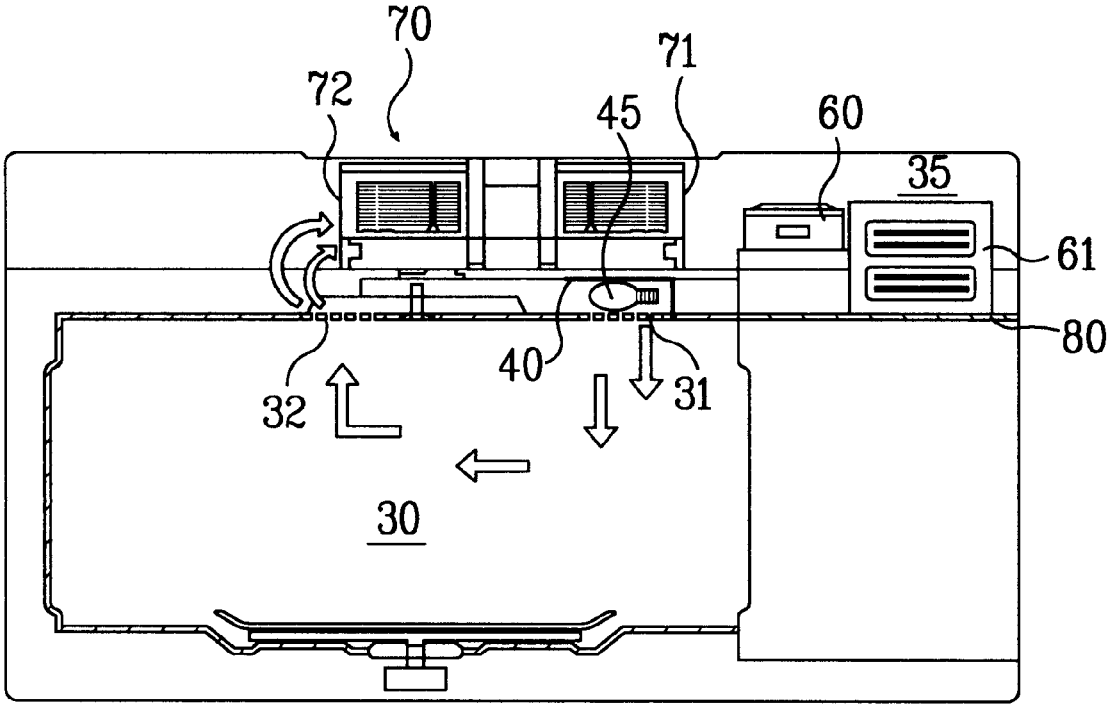
FIG. 4 illustrates a section showing an air flow of a ventilation system of a microwave oven in accordance with a first preferred embodiment of the present invention.

The present invention is applicable to a microwave oven having an electric fitting room 35 at a height of an upper surface of a cavity 30 so that a ventilation motor assembly 70 on the upper surface of the cavity 30 draws air from a front of a right upper part and cools down the electric fitting room 35, wherein, referring to FIGS. 3 and 4, the microwave oven is divided into a cavity 30 for heating food, and an electric room 35 above the cavity 30 having electric fittings provided therein.

There is an air inlet and lighting window 31 in a right part (see FIG. 3) of an upper surface of the cavity 30 for drawing air, an air outlet 32 in a central part of the upper surface of the cavity 30. Both the air inlet and lighting window 31 and the air outlet 32 are perforated. There is a lamp bracket 40 of a "]", or "[" form fitted over the air inlet and lighting window 31. A lamp 45 is fitted to a fitting hole 41 formed in a side surface of the lamp bracket 40, and lights an inside of the cavity 30 through the air inlet and lighting window 31. There is an air duct 50 on the cavity 50 for guiding an air flow from the upper part of the cavity 30 to the air inlet and lighting window 31, as well as an air flow from an air outlet. There is a mounting floor 80 in an upper part of the electric fitting room 35 at a height the same with the cavity 30, for fitting electric components, such as a magnetron 60 and a high voltage transformer 61. There is a ventilation motor assembly 70, a primitive power for causing the air flow in the microwave oven, is fitted to a rear of the central part of the upper surface of the cavity 30. The ventilation motor assembly 70 has air inlets 71 and 72 at both ends, for drawing ambient air and discharging to outside of the microwave oven, thereby forming an air flow in the microwave oven.

The ventilation of the ventilation structure and the lighting of the lamp fitting structure therefor, of the microwave oven, in accordance with a first preferred embodiment of the present invention will be explained with reference to the attached drawings.

A part of the air introduced into an upper part of the electric fitting room 35 through a vent grill (not shown) fitted to a front of an upper part of a microwave oven cools down electric fittings, such as the magnetron 60, the high voltage transformer 61, and the like, drawn into a right side inlet 71 of the ventilation motor assembly, and discharged to outside of the microwave oven. Rest of the air drawn through the vent grill is introduced into the cavity 30 through the air inlet and lighting window 31 formed in the upper part of the cavity 30.

In the meantime, the air introduced into the cavity 30 comes out of the air outlet 32 in the upper part of the cavity 30 together with the water vapor generated in the cavity during cooking, and is induced to the left side air inlet 72 following a form of the air duct 50. During cooking in the microwave oven, a light from the lamp 45 passes through the air inlet and lighting window 31 in the upper surface of the cavity 30, and illuminates an inside of the cavity 30. In this instance, in the first embodiment, the lamp 45 is cooled down by the air introduced into the cavity 30 through the air inlet and lighting window 31. Moreover, in the first embodiment, a downward air flow from the air inlet and lighting window 31 prevents the water vapor and the oily gases generated at the food in the cavity 30 during cooking from coming into contact with the lamp 45 fitted over the air inlet and lighting window 31.

Figure 5:
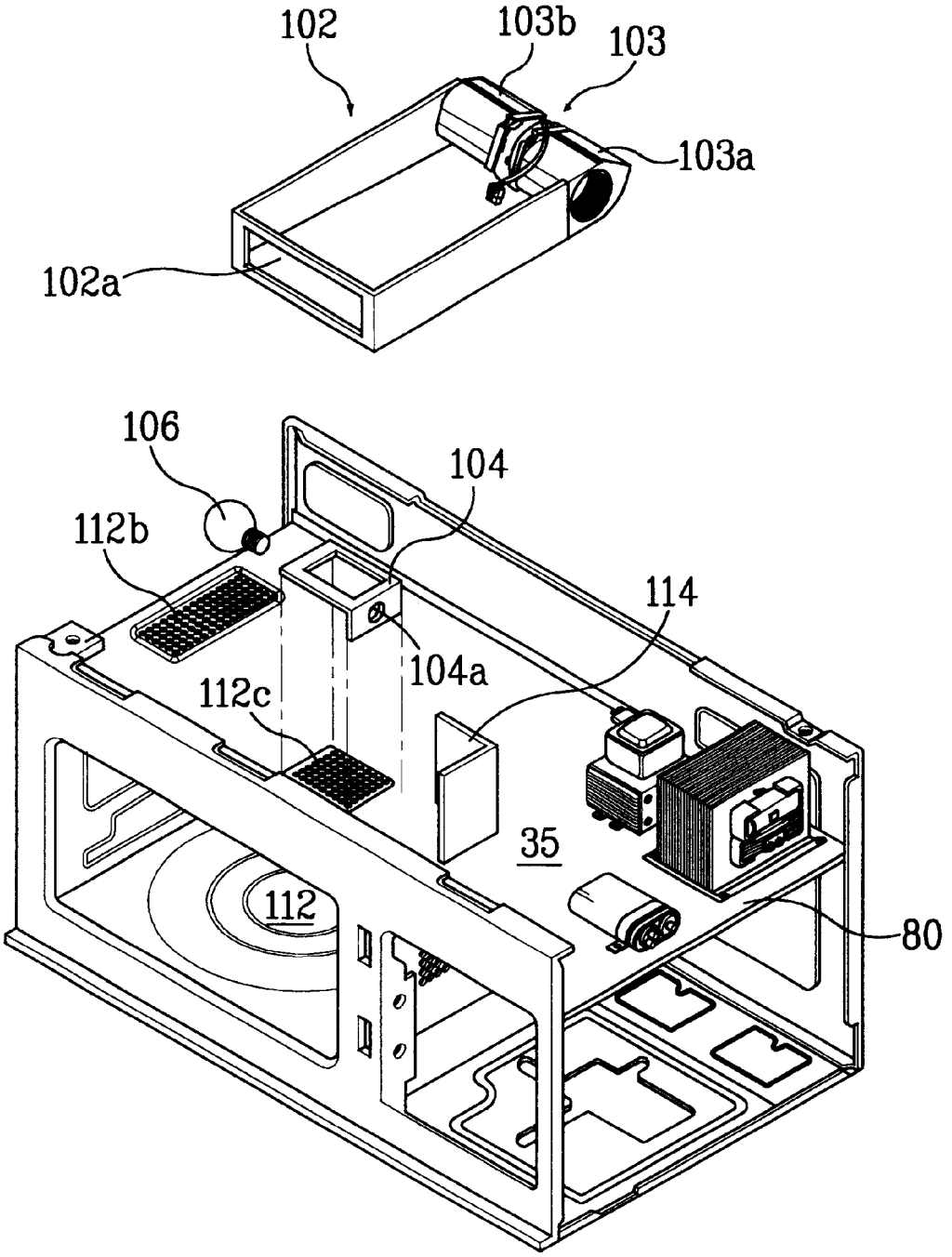
FIG. 5 illustrates a perspective view of a disassembled microwave oven showing a ventilation structure and a lamp fitting structure therefor in accordance with a second preferred embodiment of the present invention.
Figure 6:
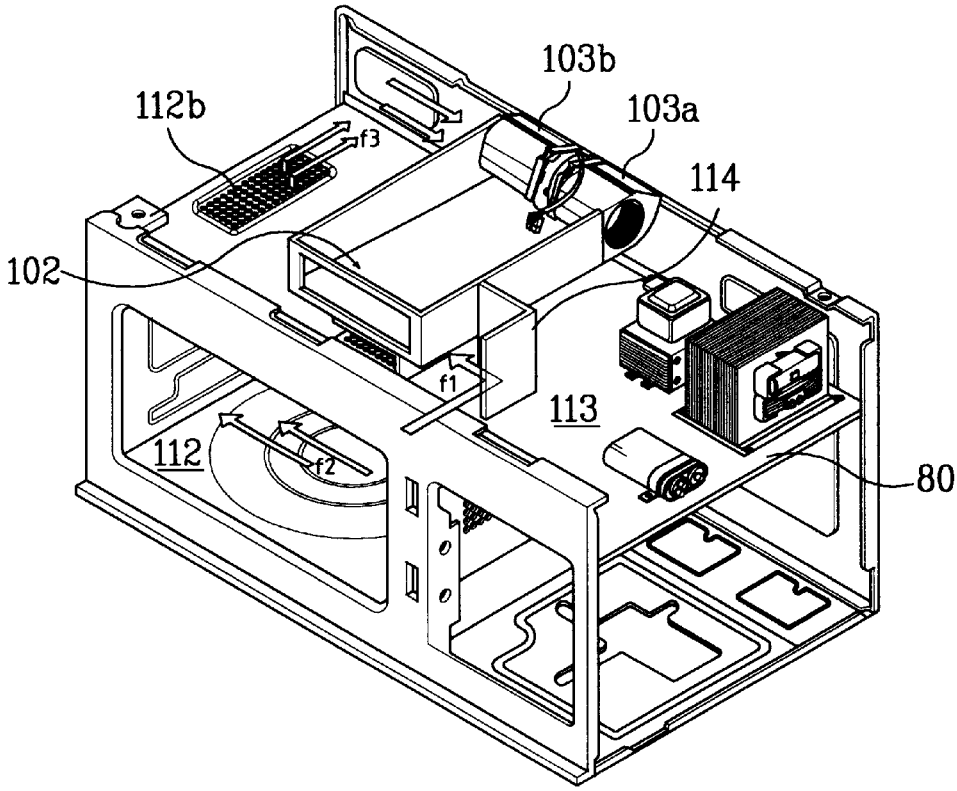
FIG. 6 illustrates an assembled view of FIG. 5.
Figure 7:
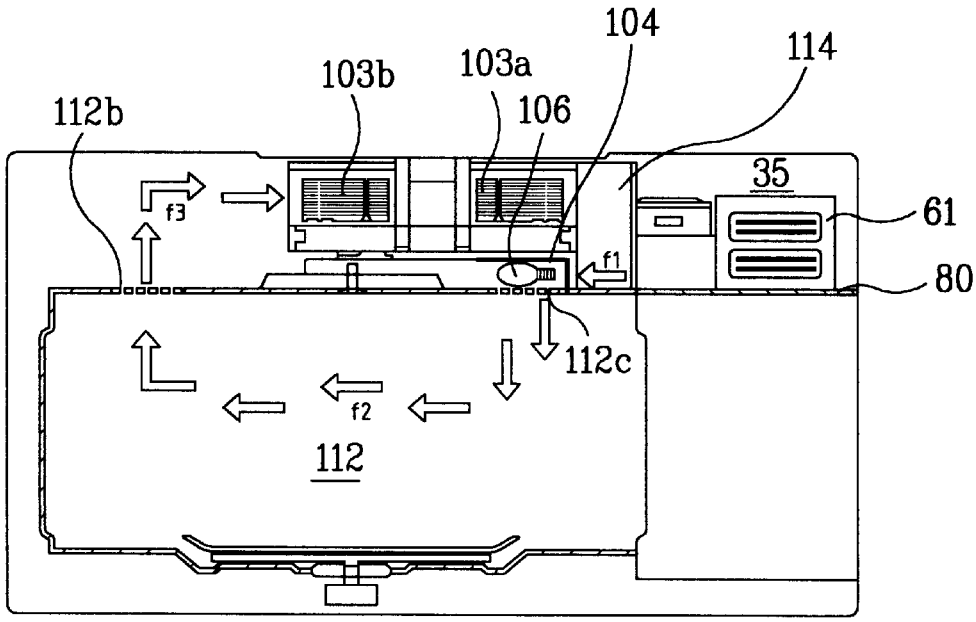
FIG. 7 illustrates a section showing an air flow of the ventilation structure in accordance with a second preferred embodiment of the present invention.

The ventilation structure and the lamp fitting structure therefor in accordance with a second preferred embodiment of the present invention will be explained, with reference to FIGS. 5 to 7. FIG. 5 illustrates a perspective view of a disassembled microwave oven showing a ventilation structure and a lamp fitting structure therefor in accordance with a second preferred embodiment of the present invention, FIG. 6 illustrates an assembled view of FIG. 5, and FIG. 7 illustrates a section showing an air flow of the ventilation structure in accordance with a second preferred embodiment of the present invention.

As shown in the drawings, a ventilation motor having a left and a right fans 103*a* and 103*b* fitted thereto is mounted on an upper surface of rear of an air duct 102. The air duct of a box form with an opened upper surface has an air outlet 102*a* in a front surface for discharging the air from the left and right side fans 103*a* and 103*b*. There is a lamp bracket 104 having a fitting hole 104*a* at one side under a bottom surface of the air duct 102. There is a lamp 106 fitted to the fitting hole 104*a* in the lamp bracket 102. There is a cavity 112, a cooking space, under the air duct 102, and a perforated air inlet and lighting window 112*c* in one side part of the upper surface of the cavity 112 at a position opposite to the lamp 106. That is, a light from the lamp 106 illuminates the cooking space in the cavity 112 through the air inlet and lighting window 112*c*.

There is a guide wall 114 on the cavity at a right side surface of the air inlet and lighting window 112*c*. The guide wall 114 guides a portion of air, introduced into a front part of the vent grill (not shown) of a microwave oven by a suction force of a right side fan 103*a* of the ventilation motor 103, to flow to the air inlet and lighting window 112*c*.

There is a perforated air outlet 112*b* formed directly in the upper surface of the cavity 112 in a right side part of the upper surface of the cavity 112. The air in the cavity 112 is discharged to outside of the cavity 112 through the air outlet 112*b*, and discharged outside of the microwave oven by the left side fan 103*b* of the ventilation motor 103 fitted to the air duct 102.

FIG. 7 illustrates a longitudinal section of a cavity showing an air flow 'f' during ventilation of the microwave oven of the present invention, showing the air introduced into the cavity 112 through the air inlet and lighting window 112*c* in the upper surface of the cavity 112 passes through the cooling space in the cavity 112 and is discharged through the air outlet 112*b*, well.

The ventilation work of the ventilation structure in accordance with the second preferred embodiment of the present invention will be explained.

The air flow in the cavity during operation of the microwave oven will be described. The air is introduced into the microwave oven from a right side of the front surface of a vent grill (not shown) by the right side fan 103*a* of the ventilation motor 103 fitted rear of the air duct 102. The air introduced into the microwave oven is divided by the guide wall 114 such that a portion thereof, guided by the guide wall 114, flows toward the air inlet and lighting window 112*c*, and rest of the air flows into the electric fitting room 113. According to this, the air introduced into the electric fitting room cools down the electric fitting room 113 in an upper part of the microwave oven, and the air, flowing toward the air inlet and lighting window 112*c* through a space under the air duct 102 guided by the guide wall 114, cools down the lamp. Thus, the lamp 106 at the lamp bracket 104 fitted to a lower part of the air duct 102 is cooled down by the foregoing air flow, adequately. The downward air flow with reference to the air inlet and lighting window 112*c* prevent the water vapor and the like in the cavity 112 from escaping through the air inlet and lighting window 112*c*. On the other hand, the air introduced into the cavity 112 through the air inlet and lighting window carries away the water vapor in the cavity 112 through the air outlet 112*b*. The f1, f2, and f3 in FIG. 7 illustrate an air flow in the ventilation structure of a microwave oven in accordance with a second preferred embodiment of the present invention, wherein the air passed through the air inlet and lighting window 112*c* flows as represented by f1 guided by the guide wall, flows as represented by f2 in the cavity 112, and flows as represented by f3 after the air escapes through the air outlet 112*b*.

In the meantime, the guide wall 114 may be formed as a unit with the air duct 102, or as a unit with the upper surface of the cavity 112, or an individual piece. The lamp bracket 104 over the air inlet and lighting window 112*c* may also be formed as a unit with the air duct 102.

The first or second embodiment ventilation structure of a microwave oven of the present invention has the following advantages.

In the ventilation structure of a microwave oven of the present invention, a portion of the air introduced into the microwave oven through the vent grill is introduced into the cavity through the air inlet and lighting window, and a lamp is fitted at a part over the air inlet and lighting window. Therefore, different from the related art, since a back flow of the air through the air inlet and lighting window is prevented, the heat resistant tape attached to the air inlet and lighting window can be dispensed with, to reduce an assembly man-hour, and save a production cost.

Also, since the air introduced into the cavity through the air inlet and lighting window cools down the lamp, a lifetime of the lamp can be prolonged.

The shortened distance between the air inlet and lighting window over the cavity and the air outlet than that of the related art permits to form the air duct smaller, to save a material cost, and reduce weight of the product.

Though the related art ventilation structure requires a separate air inlet at a side of the cavity for introduction of air into the cavity, since the ventilation structure of the present invention permits both the lamp light illumination of the cavity and the introduction of the air into the cavity by using the air inlet and lighting window over the cavity in common, a fabrication process can be simplified and a fabrication cost is saved.

It will be apparent to those skilled in the art that various modifications and variations can be made in the ventilation structure of a microwave oven of the present invention without departing from the spirit or scope of the invention. Thus, it is intended that the present invention cover the modifications and variations of this invention provided they come within the scope of the appended claims and their equivalents.

What is claimed is:

1. A ventilation structure of a microwave oven comprising:

an upper surface and a lower surface defining a cooking space therein having an inlet in the upper surface of the cooking space configured to admit both air and light into the cooking space;

an air outlet in the upper surface of the cooking space configured to discharge air from the cooking space;

an electric component room having a mounting floor disposed at approximately the same height as the upper surface of the cooking space configured to support electric components thereon;

a ventilation motor assembly fitted above the cooking space for drawing air in the cooking space through the air outlet, and cooling an electric component in the electric component room; and, an air duct fixed above the cooking space for separating a passage of air discharged to outside of the cooking space through the air outlet and drawn into the ventilation motor assembly, and a passage of air drawn into the ventilation motor assembly through the electric component room.

2. A ventilation structure as claimed in claim 1, wherein the air duct has a form of a box comprising an open upper surface, and an outlet in a front surface of the air duct for discharging air blown by the ventilation motor assembly through a vent grill.

3. A ventilation structure as claimed in claim 1, further comprising a guide wall on the upper surface of the cooking space configured to divide a portion of the air introduced into the electric component room and to guide that portion of the air toward the inlet.

4. A ventilation structure as claimed in claim 3, wherein the guide wall is formed as one unit with the air duct.

5. A ventilation structure as claimed in claim 3, wherein the guide wall is formed as one unit with the cooking space at an upper surface of the cooking space.

6. A ventilation structure as claimed in claim 1, further comprising a lamp between the air duct and the air inlet and lighting window for illumination of an inside of the cooking space.

7. A ventilation structure as claimed in claim 6, wherein the lamp is fixed to a lamp bracket fixed to a bottom of the air duct.

8. A ventilation structure as claimed in claim 7, wherein the lamp bracket comprises an approximately 90° bend.

9. The ventilation structure of claim 1, wherein the inlet is configured to introduce a portion of air introduced into an electric fitting component room and into the cooking space.

10. A lamp supporting structure of a microwave oven comprising:

an upper surface and a lower surface defining a cooking space therein;

an inlet in an upper surface of the cavity configured to admit air and light into the cooking space;

an air outlet in the upper surface of the cooking space configured to discharge air from the cooking space;

an electric component room comprising a mounting floor disposed at approximately the same height as the upper surface of the cooking space configured to support electric components thereon;

a ventilation motor assembly fitted above the cooking space for drawing air in the cooking space through the air outlet, and cooling an electric component in the electric component room;

an air duct fixed over, and spaced a prescribed distance from, the upper surface of the cooking space configured to separate air discharged outside the cooking space through the air outlet from air drawn into the ventilation motor assembly through the electric component room;

a lamp bracket fixed between the air duct and the inlet; and, a lamp fixed to the lamp bracket configured to illuminate the cooking space.

11. The lamp supporting structure as claimed in claim 10, wherein the lamp bracket is fixed to a bottom of the air duct.

12. The lamp supporting structure as claimed in claim 10, wherein the lamp bracket comprises an approximately 90° bend.

* * * * *